US009752744B2

(12) United States Patent
Muller et al.

(10) Patent No.: US 9,752,744 B2
(45) Date of Patent: Sep. 5, 2017

(54) LED LIGHT

(71) Applicants: HDO Druckguss-und Oberflaechentechnik GmbH, Paderborn (DE); Hella KGaA Hueck & Co, Lippstadt (DE)

(72) Inventors: Karl-Josef Muller, Buren (DE); Michael Franzke, Hovelhof (DE); David Duhme, Lippstadt (DE); Werner Kosters, Lippstadt (DE)

(73) Assignee: HDO Druckguss-und Oberflaechentechnik GmbH (DE)

( * ) Notice: Subject to any disclaimer, the term of this patent is extended or adjusted under 35 U.S.C. 154(b) by 131 days.

(21) Appl. No.: 14/638,486

(22) Filed: Mar. 4, 2015

(65) Prior Publication Data

US 2015/0252973 A1 Sep. 10, 2015

(30) Foreign Application Priority Data

Mar. 6, 2014 (EP) ..... 14158090
Jun. 24, 2014 (EP) ..... 14002159

(51) Int. Cl.
*F21V 7/00* (2006.01)
*B60Q 1/00* (2006.01)
(Continued)

(52) U.S. Cl.
CPC ..... *F21S 48/1109* (2013.01); *F21S 48/115* (2013.01); *F21S 48/1159* (2013.01);
(Continued)

(58) Field of Classification Search
CPC ..... F21V 17/16; F21V 17/104; F21V 17/164; F21V 19/0045; F21S 48/1122;
(Continued)

(56) References Cited

U.S. PATENT DOCUMENTS 4,432,594 A * 2/1984 Daggett ..... H01H 85/205 439/698
2005/0180157 A1* 8/2005 Watanabe ..... F21S 48/1104 362/543

(Continued)

FOREIGN PATENT DOCUMENTS

EP 2317213 5/2011
EP 2522898 11/2012
JP 2009295369 12/2009

*Primary Examiner* — Jong-Suk (James) Lee
*Assistant Examiner* — Erin Kryukova
(74) *Attorney, Agent, or Firm* — Berenato & White, LLC

(57) ABSTRACT

The invention relates to a LED vehicle headlight. Each light unit has a LED board with a luminous surface and an optical device associated with a reflector and/or a lens. A reflector holder carries the optical devices of the light units and is formed in one piece with the latter. A board holder is fastened detachably to the reflector holder. The board holder has a receptacle for each light unit, and the LED board has contact surfaces that come into contact with corresponding contact surfaces on the reflector holder to position the LED board with respect to the assigned optical device when the board holder is fixed on the reflector holder. Each light unit has elastic pressurizing means that act on the LED board in order to press its contact surfaces against the contact surfaces of the reflector holder when the board holder is fixed on the reflector holder.

16 Claims, 10 Drawing Sheets

(51) Int. Cl.

| | |
|---|---|
| ***B60Q 3/00*** | (2017.01) |
| ***F21S 8/10*** | (2006.01) |
| ***F21V 21/00*** | (2006.01) |
| *F21W 101/10* | (2006.01) |
| *F21Y 115/10* | (2016.01) |

(52) U.S. Cl.
CPC ..... *F21S 48/1216* (2013.01); *F21S 48/1305* (2013.01); *F21S 48/1323* (2013.01); *F21S 48/1208* (2013.01); *F21W 2101/10* (2013.01); *F21Y 2115/10* (2016.08)

(58) Field of Classification Search
CPC .. F21S 48/1109; F21S 48/1159; F21S 48/115; F21S 48/1305; F21S 48/1208; F21S 48/1323; F21S 48/1216; F21S 48/1104; F21S 48/1113; F21S 48/1118; F21S 48/1154; F21Y 2101/00; F21W 2101/10
USPC ..... 439/56, 698; 220/8, 23.4; 403/293, 294, 403/303
See application file for complete search history.

(56) References Cited

U.S. PATENT DOCUMENTS

| | | | | |
|---|---|---|---|---|
| 2006/0044840 | A1* | 3/2006 | Watanabe | F21S 48/1109 362/647 |
| 2007/0109806 | A1* | 5/2007 | Tsukamoto | F21S 48/1109 362/545 |
| 2007/0177401 | A1* | 8/2007 | Nakabayashi | F21S 48/1104 362/548 |
| 2008/0008427 | A1* | 1/2008 | Takeda | F21S 48/1109 385/92 |
| 2009/0023323 | A1* | 1/2009 | Lin | F21V 19/0015 439/345 |
| 2009/0096341 | A1* | 4/2009 | Dobler | F21S 48/1109 313/45 |
| 2011/0136394 | A1* | 6/2011 | Mostoller | F21K 9/00 439/701 |
| 2011/0280034 | A1 | 11/2011 | Tsukamoto | |
| 2012/0201043 | A1* | 8/2012 | DiPenti | F21S 48/1104 362/545 |

* cited by examiner

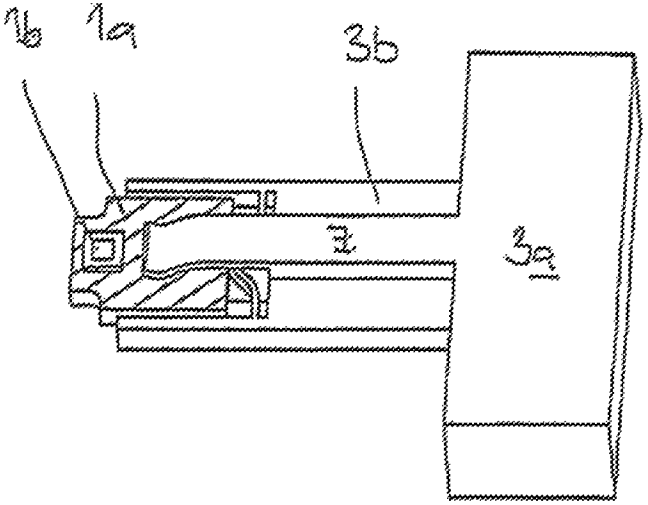
Fig. 5
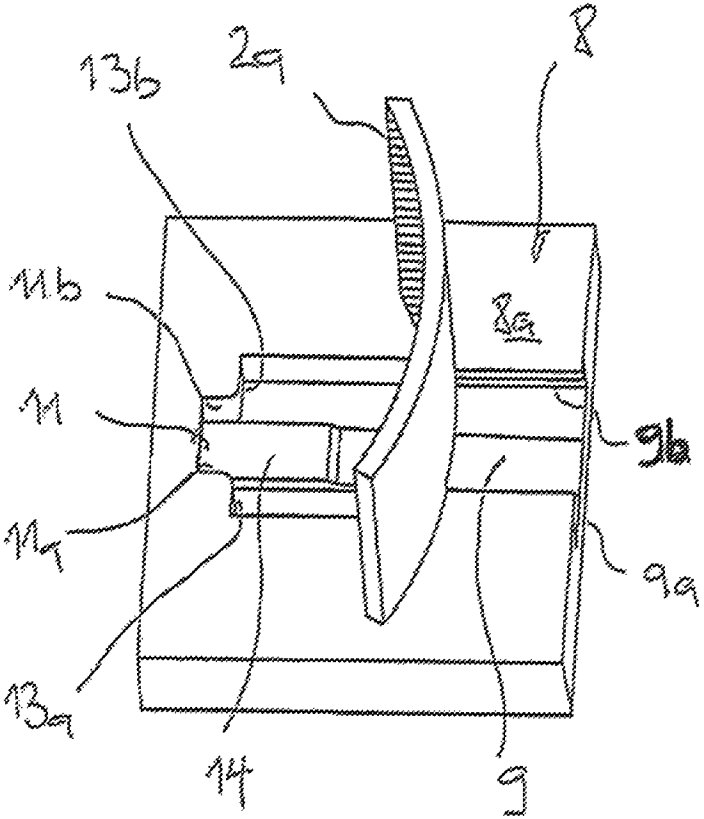

LED LIGHT

CROSS-REFERENCE TO RELATED APPLICATIONS AND CLAIM TO PRIORITY

This application is related to application number 14 158 090.2 filed in the European Patent Office on Mar. 6, 2014 and application number 14 002 159.3 filed Jun. 24, 2014 in the European Patent Office, the discloses of each of which are incorporated herein by reference and to which priority is claimed.

FIELD OF THE INVENTION

The present invention relates to a LED light, in particular a LED vehicle headlight, comprising a light unit or a number of light units, each light unit having an illuminant in the form of a LED board with a luminous surface and an optical device assigned to the illuminant with at least one reflector and/or at least one lens.

BACKGROUND OF THE INVENTION

LED lights are increasingly replacing other lights because they have a longer life and emit a comparably small amount of heat radiation. In the field of motor vehicle lighting too, main headlights are meanwhile being used which produce dipped light using LED technology or which are even configured as full LED headlights and so are replacing conventional xenon headlights.

The production of dipped light using LED technology generally requires four light units with LEDs and optical devices assigned to the latter in the form of reflectors and/or lenses to be provided, two light units respectively consisting of LEDs and an assigned optical device for illuminating the forefield and two light units for the full range being appropriate.

Used as LED illuminants here are LED boards which have a flat substrate which are equipped with the required LEDs and optionally additional electronic components. Additionally provided are connecting surfaces by means of which the LED boards can be connected to wires. The connecting surfaces are generally tin-plated copper surfaces which are used for the soldered connection of wires. The LEDs then form a luminous surface of the LED boards.

When used in main headlights of vehicles the LEDs must be positioned with great precision with respect to the reflectors, and this makes high demands of production. For this reason LED main headlights of vehicles are fully set during production. The disadvantage here is that the illuminants can not be replaced. Accordingly, if an illuminant is defective, it is often necessary the replace the whole headlight.

SUMMARY OF THE INVENTION

It is therefore the object of the present invention to configure an LED light, in particular an LED vehicle headlight of the type specified at the start, such that the positioning of the LED boards, and so of the luminous surfaces, with respect to the assigned reflectors is simplified and so assembly is facilitated. In particular, it should also be made possible to change the illuminants.

This object is achieved in an LED light of the type specified at the start in that a reflector holder is provided that carries the optical devices of the light unit or light units that are provided and in particular is formed in one piece with the latter, that a board holder is provided that is fastened detachably to the reflector holder, that the board holder has a receptacle for each light unit in which the LED board of the light unit is positioned, the LED board having contact surfaces that come into contact with corresponding contact surfaces on the reflector holder in order to position the LED board in the receptacle with respect to that of the assigned optical device when the board holder is fixed on the reflector holder, and that there are assigned to each light unit elastic pressurising means which are provided on the board holder and/or the reflector holder and act on the LED board of the light unit in order to press its contact surfaces against the contact surfaces of the reflector holder when the board holder is fixed on the reflector holder.

The LED light according to the invention thus comprises two main structural components, namely on the one hand the reflector holder, which carries the optical devices, and on the other hand the board holder, which is connected detachably to the reflector holder. The LED boards are inserted here into the receptacles of the board holder and are pre-positioned in the latter. The final positioning of the board holder only takes place when the board holder is fitted on the reflector holder. For this purpose the LED boards and the reflector holder have contact surfaces that correspond to one another and which, in the fitted state, come into contact with one another and ensure that the LED boards are positioned in all directions with respect to the reflector holder and so with respect to the reflectors assigned to them. It is guaranteed here by elastic pressurising means that the contact surfaces of the LED boards are pressed against the corresponding contact surfaces of the reflector holder. As a result, it is only necessary for the fitting of the LED light according to the invention to fasten, for example screw, the board holder with LED boards inserted into the receptacles onto the reflector holder. The LED boards are then automatically pressed by the elastic pressurising means against the contact surfaces of the reflector holder and are thus positioned. Complex setting is therefore not required. Likewise, it is possible to change the illuminants. For this purpose only the board holder needs to be detached from the reflector holder. Then, individual LED boards can be replaced. Alternatively, the whole board holder with the LED boards can also be changed. In this case control electronics for the LED boards are advantageously provided for the LED boards on the board holder.

The reflector holder and the reflectors are preferably made in one piece so that they can be produced, for example, as a cast part. In this way production tolerances can be minimised. At the same time, the dissipation of heat from the LED boards is aided. Since the board holder only performs pre-positioning of the LED boards on the reflector holder, the requirements for production tolerances relating to the board holder are not stringent, and so that latter can be produced inexpensively.

According to one embodiment of the invention provision is made such that each receptacle for an LED board is open to a front face side of the board holder and the assigned LED board on the open face side projects out of the receptacle, on the end section of the LED board projecting out of the receptacle the contact surfaces of the LED boards being designed for the positioning of the LED boards with respect to the respective associated optical device.

Preferably, the board holder has a board holder body and there is assigned to each light unit a carrier arm which projects in a straight line from the front side of the board holder body, the receptacle for the LED board of the light unit being formed on the free front end section of the carrier arm. There is assigned to the carrier arm of each light unit a corresponding carrier receptacle in the reflector holder into which the carrier arm is inserted or can be inserted in a straight line from the rear side of the reflector holder, the carrier receptacle defining in particular lateral guide grooves in which the lateral edges of the assigned carrier arm engage. In order to fit the board holder, in this configuration only the carrier arms of the board holder need be inserted into the corresponding carrier receptacles of the reflector holder until the board holder body comes to rest against the reflector holder body, for which purpose corresponding stop surfaces are provided on the board holder body and the reflector holder body. In this final position the board holder body is then fixed to the reflector holder body. In order to position the LED boards, according to one embodiment of the invention the latter can be moved in the associated receptacles parallel to the direction of extension of the carrier arms and so also of the direction of insertion Z, and there are provided in the rear end region of the receptacles of the board holder elastic pressurising means which push the LED boards elastically out of the receptacles.

The LED boards can have on their front end region a centering projection which engages in a corresponding centering recess of the associated carrier receptacle in order to center the LED boards in a Y direction running transversely to the direction of insertion Z, the centering projection and the centering recess respectively having lateral contact surfaces lying opposite one another. Furthermore, the LED boards and the reflector holder have contact surfaces in order to position the LED boards on the reflector holder in the direction of insertion Z, these Z contact surfaces of the LED boards preferably being formed on opposite sides of the centering projection. In this configuration the Z contact surfaces of the LED boards come into contact with the corresponding contact surfaces of the reflector holder when the carrier arms are inserted into the carrier receptacles. When the carrier arms are inserted further, the elastic pressurising means are elastically compressed at the rear end region of the receptacles of the board holder and are thus tensioned so that the LED boards are positioned in the direction of insertion. At the same time the centering projections of the LED board engage with the corresponding centering recesses of the reflector holder in order to position the LED boards in the Y direction.

In order to position the LED boards in an X direction, which runs transversely to the direction of insertion Z and the YZ plane, the lower sides of each LED board preferably form a contact surface, the corresponding contact surfaces of the reflector holder being elevated from the bottom of the carrier receptacles. In addition, elastic pressurising means or spring elements are provided on the reflector holder or the board holder which act on the upper sides of the LED boards in order to press the lower sides of the LED boards against the corresponding contact surfaces of the reflector holder. For this purpose elastic pressurising means, for example in the form of leaf springs, can be provided on the board holder which extend over the open upper side of the receptacles and are designed to push an LED board inserted into the receptacle down towards the bottom of the receptacle. In particular, the leaf springs can be held on the carrier arms on their rear side end region and extend towards the front side over the receptacles. By means of the pressurising media provided, two-dimensional contact between the LED board and the reflector holder is guaranteed, by means of which good thermal contact between the components is also ensured. In this way, good thermal dissipation of the heat produced during operation from the LED board into the reflector holder can take place.

A ramp incline, which interacts with the LED board in such a way that the latter is raised when the carrier arms are inserted against the reset force of the spring elements pressing down the LED board, can be assigned here to the elevated contact surface of the reflector holder.

A board holder for an LED light preferably comprises a board holder body and a carrier arm projecting in a straight line from the board holder body or a number of carrier arms projecting parallel to one another from the front side of the board holder body, each carrier arm having on its free, front end section a receptacle for an LED board that is open to the front face side of the carrier arm, there being provided in the rear region of the receptacle elastic pressurising means which are designed to press an LED board inserted into the receptacle elastically out of the receptacle.

According to one preferred embodiment provision is made such that elastic pressurising means are provided on the board holder which extend over an open upper side of the receptacle or receptacles provided and are designed to press an LED board inserted into the receptacle down towards the bottom of the receptacle, there being provided, in particular as elastic pressurising means, leaf springs on the board holder and in particular the carrier arms which are held on their rear side end region on the board holder and in particular the carrier arms and extend towards the front side over the receptacles.

Furthermore, a reflector arrangement for an LED light, in particular an LED vehicle headlight, comprising a light unit or a number of light units, is provided, each light unit having an illuminant in the form of an LED board with a luminous surface and an optical device assigned to the illuminant, comprising a reflector holder which carries the optical device of the light units provided and in particular is formed in one piece with the latter, there being assigned to each light unit a carrier receptacle in the reflector holder into which a carrier arm of a board holder can be inserted in a straight line from the rear side of the reflector holder, and there being formed in the front end region of each carrier receptacle contact surfaces in order to respectively position an LED board in the carrier receptacle, each carrier receptacle defining in particular lateral guide grooves in which the lateral edges of the assigned carrier arm engage.

According to one embodiment the reflector arrangement is characterized in that there are formed in the carrier receptacle, in particular in the region of a face side end surface of the carrier receptacle, a centering recess in order to center an LED board in a Y direction running transversely to the direction of insertion and at least one contact surface in order to position an LED board in the direction of insertion, and/or that there is formed in the region of the bottom of the carrier receptacle a contact surface which is elevated from the bottom of the carrier receptacle.

BRIEF DESCRIPTION OF THE DRAWINGS

In the drawings an exemplary embodiment of an LED light according to the invention is shown. The drawings show as follows.

DETAILED DESCRIPTION OF THE PREFERRED EMBODIMENT(S)

Figure 1:
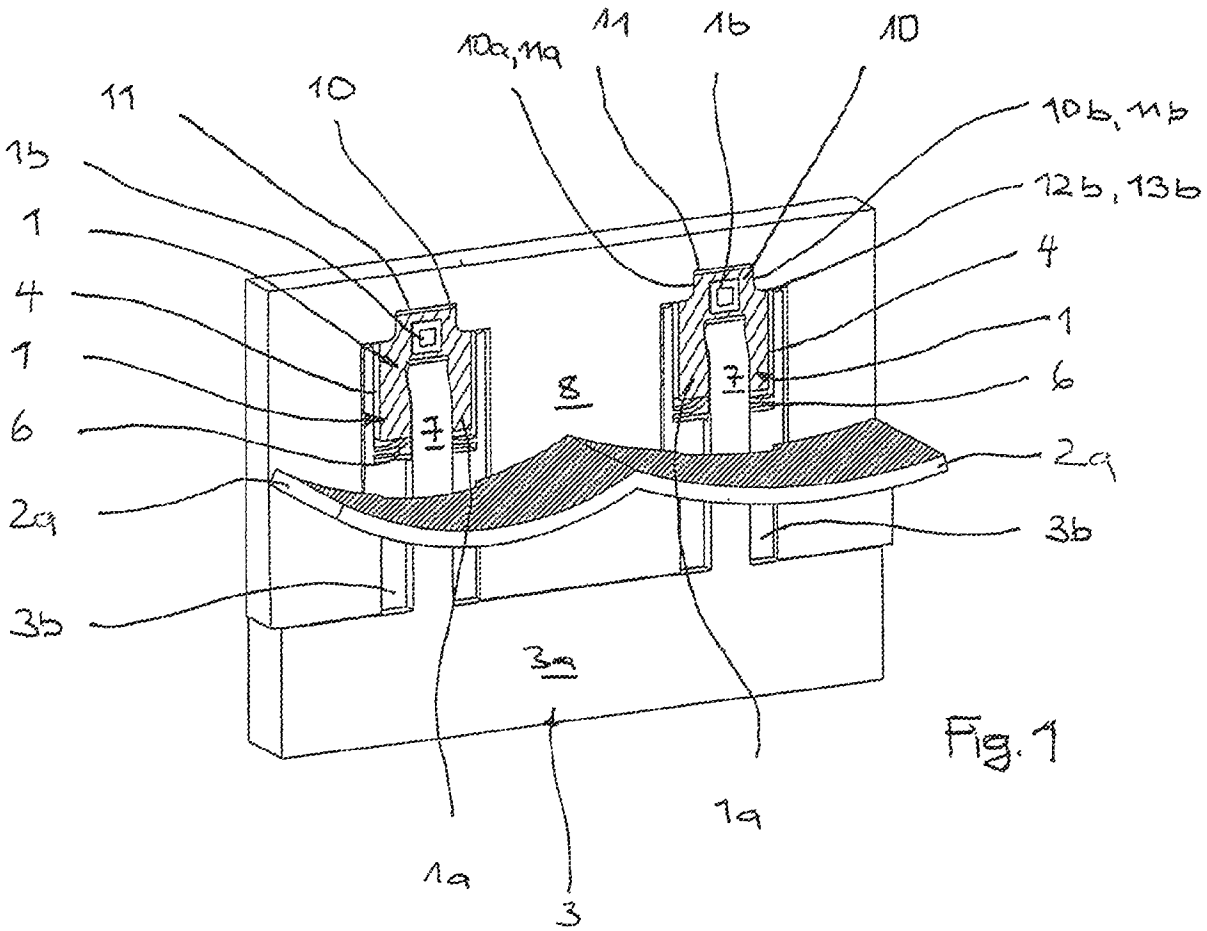
FIG. 1 an LED light according to the present invention in a perspective illustration, FIG. 2 a board holder and an LED board of the LED light from FIG. 1, FIG. 3 the board holder from FIG. 2 with LED boards pre-positioned on the latter, FIG. 4 the board holder from FIG. 3 with a reflector holder and reflectors provided on the latter, FIG. 5 a sectional illustration of the engagement region between an LED board and the reflector holder, FIG. 6 an additional LED light according to the present invention in a perspective illustration, FIG. 7 a board holder and an LED board of the LED light from FIG. 6, FIG. 8 the board holder from FIG. 7 with an LED board prepositioned on the latter, FIG. 9 the board holder from FIG. 8 with a reflector holder and a reflector held on the latter, and FIG. 10 an additional embodiment of a reflector holder with an optical device held on the latter and which comprises a reflector and a lens.

In the drawings a LED light according to an embodiment of the present invention is shown. The LED light comprises two light units which respectively have an illuminant in the form of an LED board 1 and a reflector 2*a* of an optical device assigned to the LED board 1. The optical device can have an optical lens 2*b* as an alternative to or in addition to the reflector 2*a*. The LED board 1 has, in a way known in its own right, a flat substrate 1*a* which is made to be rigid and is equipped with the required LEDs and optionally additional electronic components. The LEDs form a luminous surface 1*b* of the LED board 1. Neither the additional electronic components nor the electric connecting surfaces of the LED boards 1 are shown in the drawings.

Figure 2:
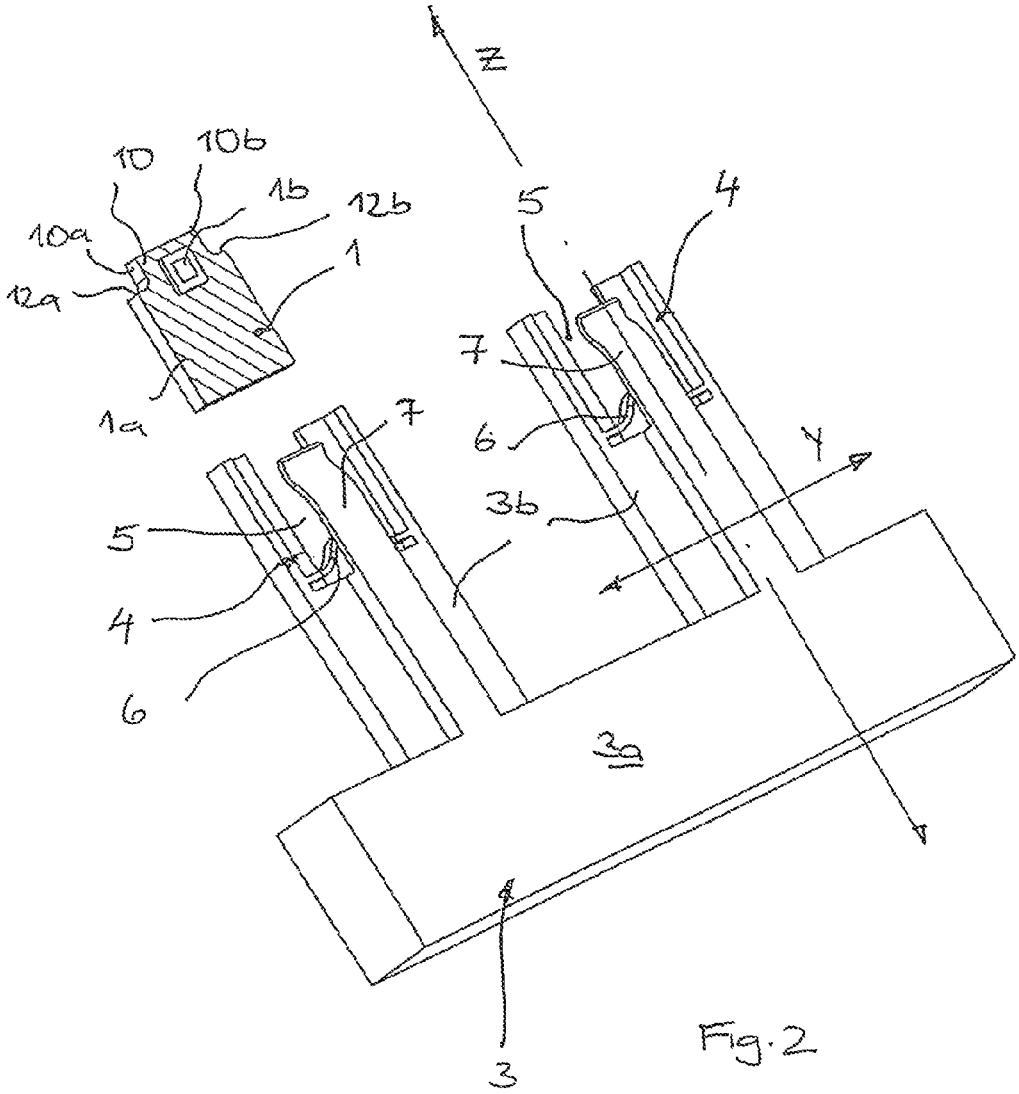
Figure 3:
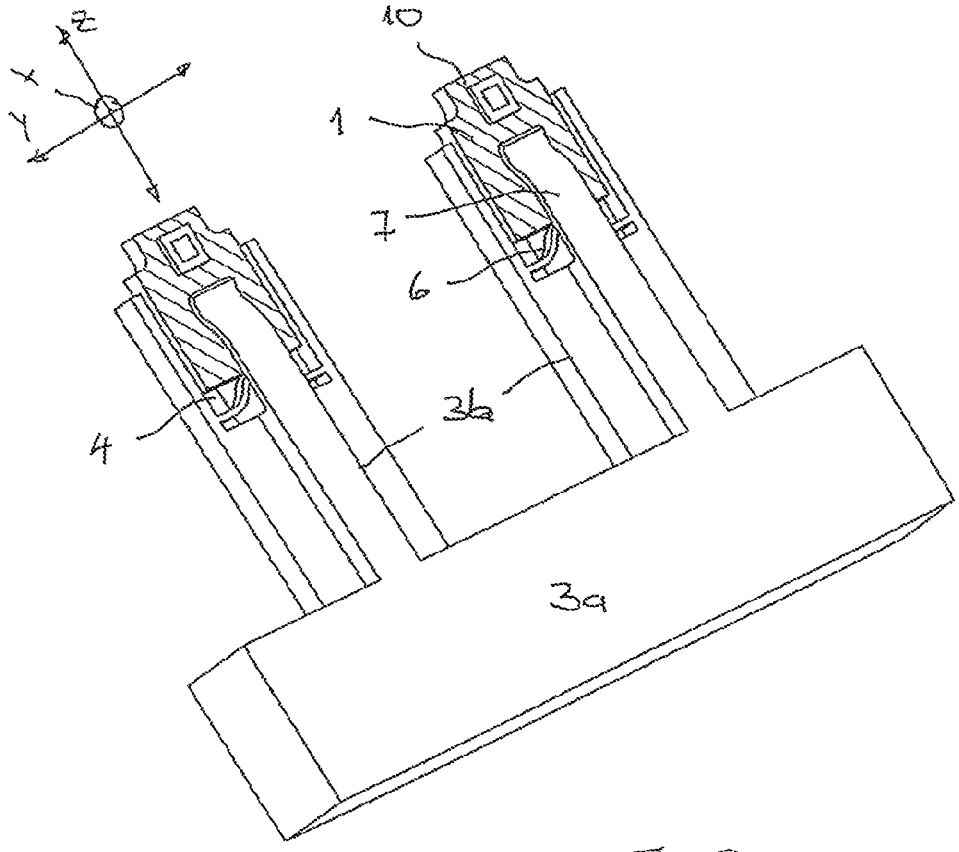
Figure 4:
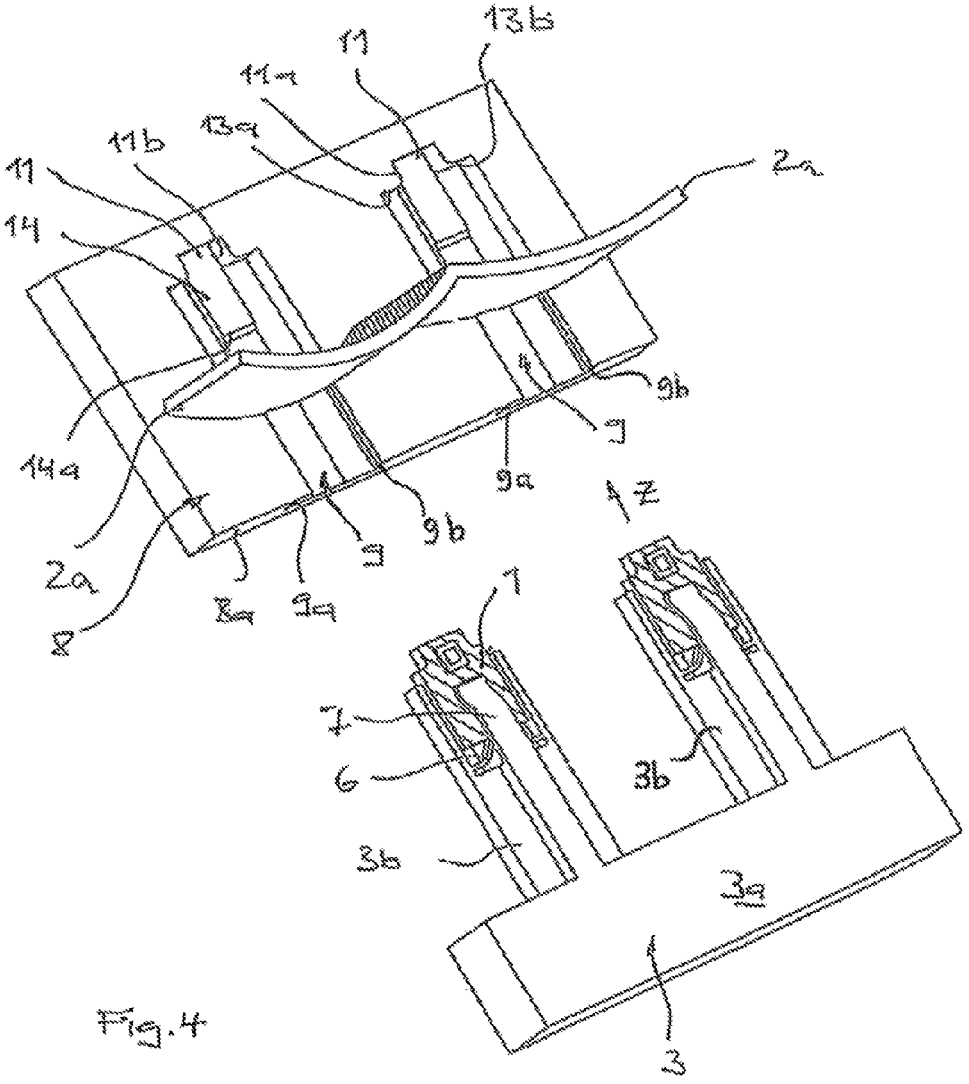
Figure 5:
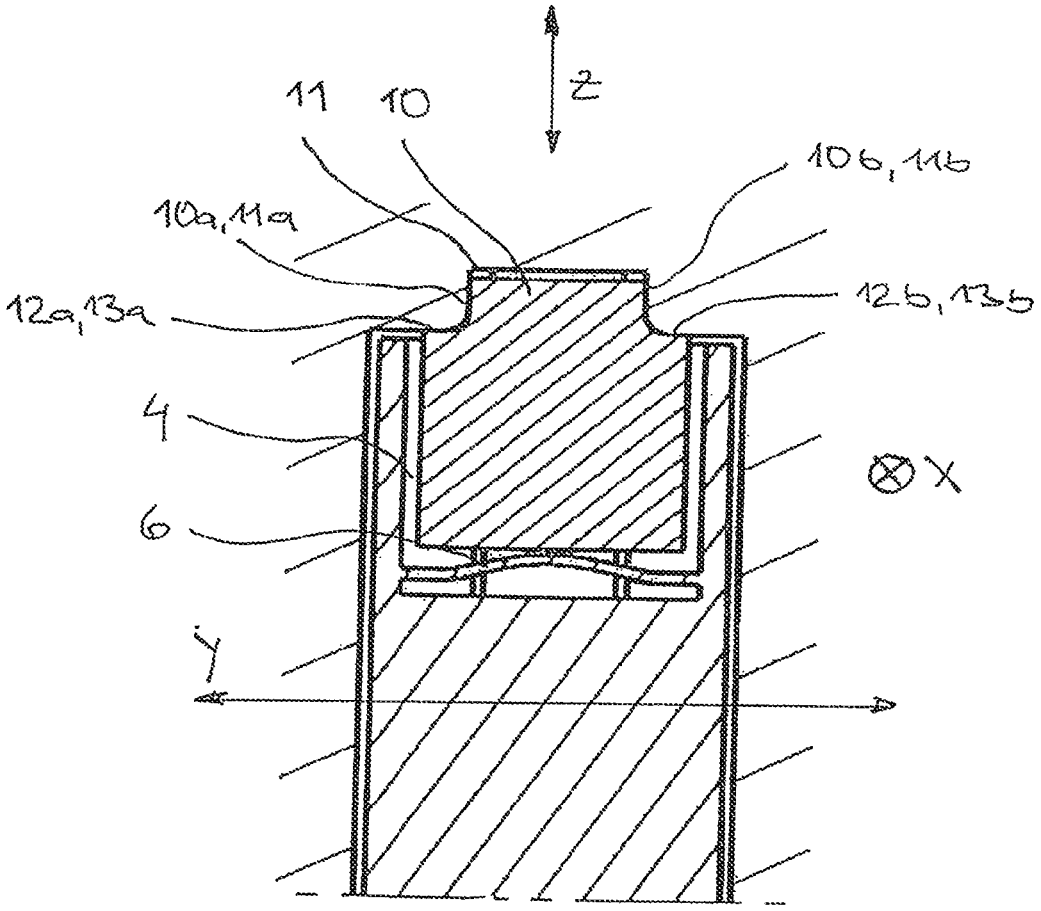
Figure 6:
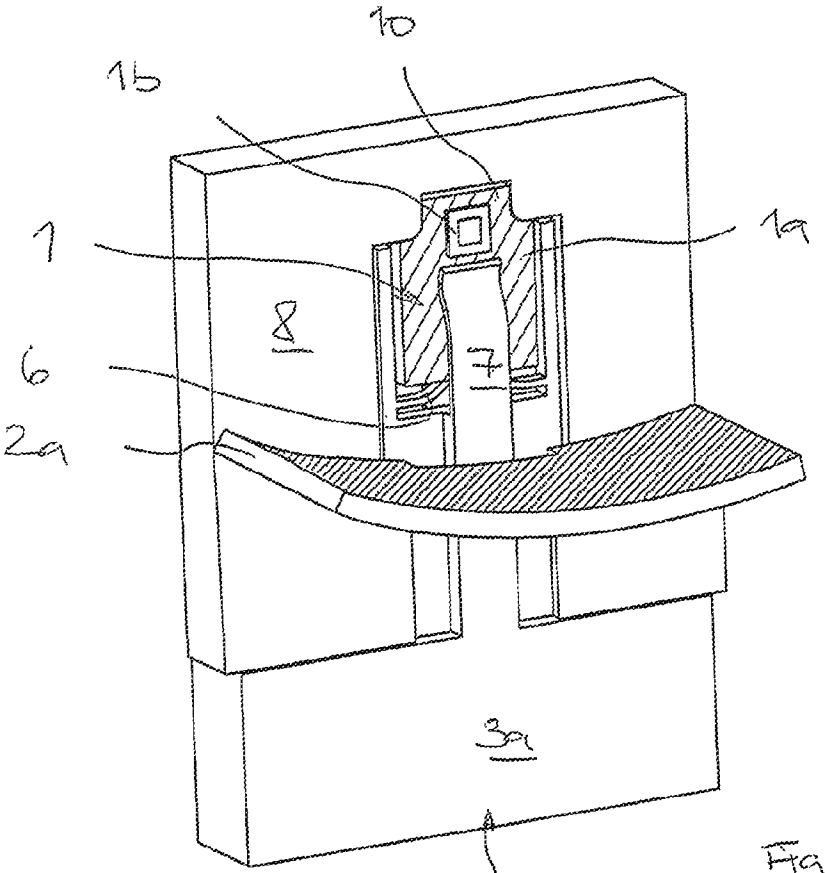
Figure 7:
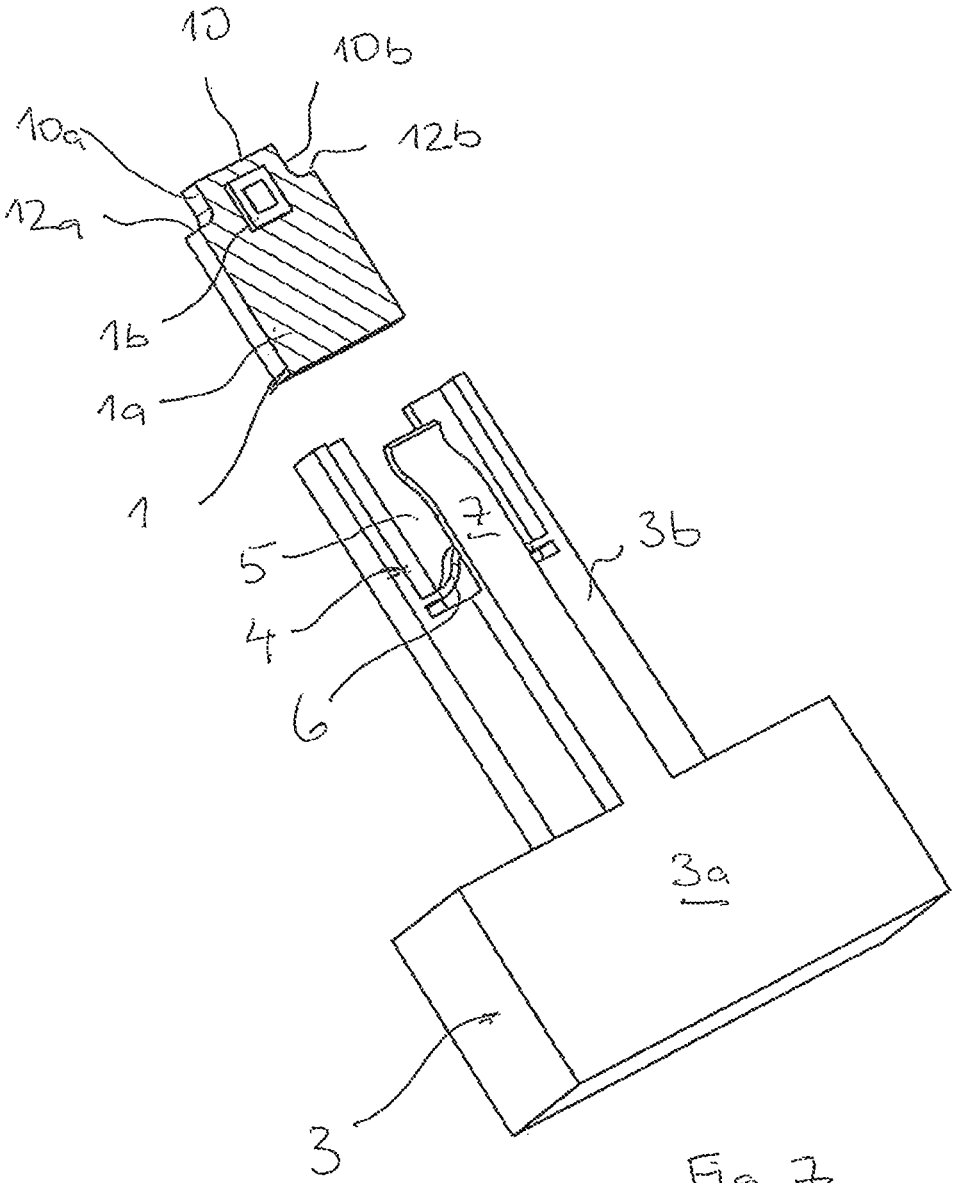
Figure 8:
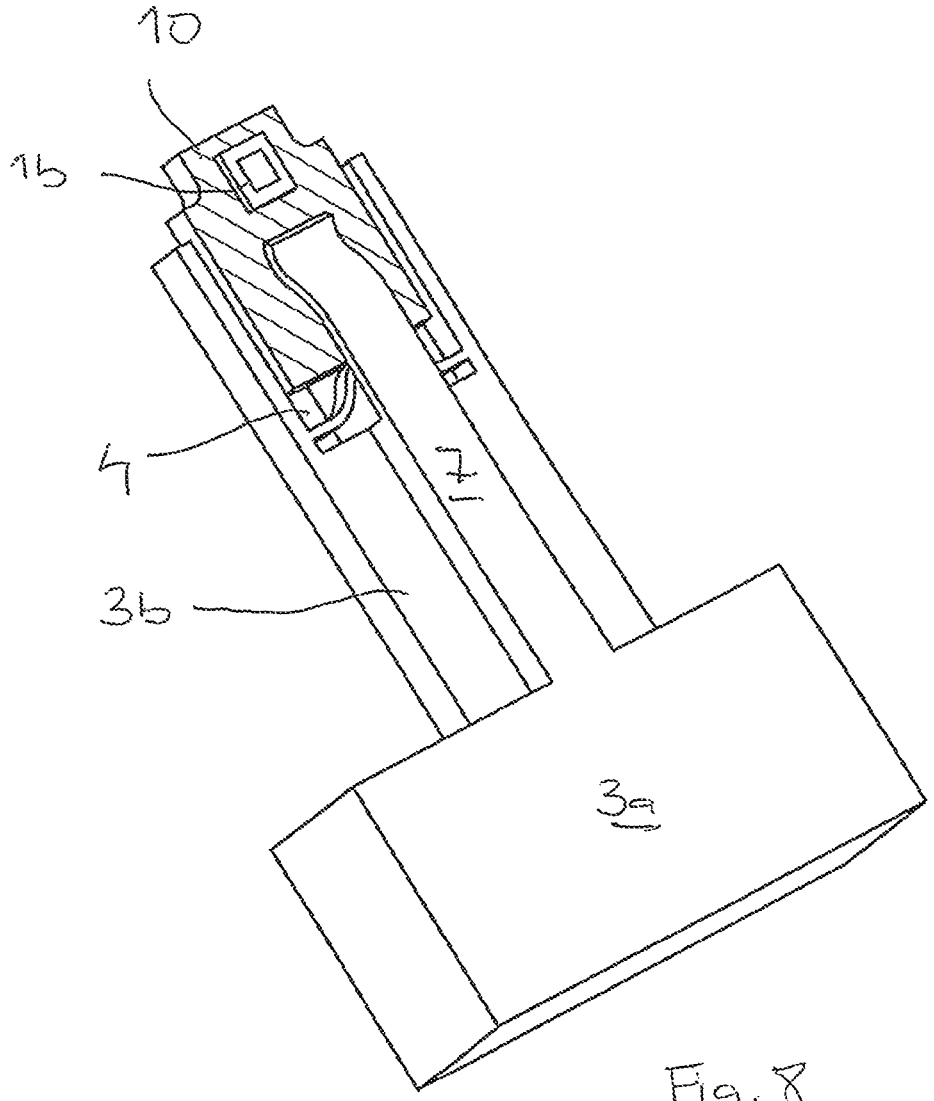

The LED boards 1 are held on a common board holder 3 which also carries the control electronics for the LED boards 1. As can be seen particularly well from FIG. 2, the board holder 3 has a board holder body 3*a* which is cuboidal in form here, and two carrier arms 3*b* which project parallel to one another from the front face side of the board holder body 3*a*. In the exemplary embodiment shown the carrier arms 3*b* project from the front face surface of the board holder body 3*a*. The carrier arms 3*b* are respectively assigned to a light unit and have on their front, free end section a receptacle 4 into which the LED board 1 of the light unit can be inserted. The receptacles 4 are open to the front face side of the carrier arms 3*b* so that the LED boards 1 project out of the receptacles 4 on the open face side. Furthermore, the receptacles 4 are open to the upper side of the carrier arms 3*b* and the bottom of the receptacle 4 is also interrupted by an opening 5 which extends from the rear side to the front side of the receptacle 4.

Respectively provided on the rear end region of the receptacles 4 is a compression spring 6 which acts to push an LED board 1 inserted into the receptacle 4 out of the receptacle 4 in the longitudinal direction 7 of the carrier arm 3*b*. The compression spring 6 is made in the form of an elastic bracket here which extends transversely to the receptacle 4 and is molded onto its side walls.

Furthermore, there is assigned to each receptacle 4 a compression spring 7 which acts on the upper side of the LED boards 1 in order to push the latter down towards the bottom of the receptacle 4. The compression spring is made in the form of a leaf spring 7 here, the rear end section of which is connected to the carrier arm 3*b* on the rear side of the receptacle 4 and which extends over the receptacle 4 in the longitudinal direction Z of the carrier arm 3*b*.

The reflectors 2 are disposed on a common reflector holder 8 and are made integrally with the latter to form a reflector arrangement. Specifically, the reflector holder 8 and the reflectors 2*a* are produced as one component in a casting process. The reflector holder 8 has two carrier receptacles 9 into which the carrier arms 3*b* of the board holder 3 can be inserted. The carrier receptacles 9 define lateral guide grooves 9*a*, 9*b* here in which the lateral edges of the carrier arms 3*b* engage. Moreover, the carrier receptacles 9 are open to their upper side.

On the front end section of the LED boards 1 on the one hand and on the front end region of the carrier receptacles 9 on the other hand, contact surfaces assigned to one another are formed in order to position the LED boards 1 in the reflector holder and so with respect to the respectively assigned reflector 2 when the carrier arms 3*b* are fully inserted into the carrier receptacles 9. This is the case if the front face surface of the board holder body 3*a* comes to rest against the rear face surface 8*a* of the reflector holder 8.

In FIGS. 6 to 9 another embodiment of an LED light according to the present invention is shown. This corresponds to the previously described embodiment with the proviso that the LED light only has a single light unit with an illuminant in the form of an LED board 1 and a reflector 2*a* of an optical device assigned to the LED board 1. Accordingly, the board holder 3 also has just one carrier arm 2*b* which projects in a straight line from the front face side of the board holder body 3*a*. In the way that has already been described, the carrier arm 3*b* has on its front, free end section a receptacle 4 into which the LED board 1 of the light unit can be inserted. There is provided on the rear end region of the receptacle 4 a compression spring 6 which acts to push an LED board 1 inserted into the receptacle 4 out of the receptacle 4 in the longitudinal direction 7 of the carrier arm 3*b* so that the LED board 1 projects out of the receptacle 4 on the open face side. Furthermore, there is assigned to the receptacle 4 a compression spring 7 which acts on the upper side of the LED board 1 in order to push the latter down towards the bottom of the receptacle 4. As in the first embodiment, the compression spring is made in the form of a leaf spring 7 the rear end section of which is connected to the carrier arm 3*b* on the rear side of the receptacle 4 and which extends over the receptacle 4 in the longitudinal direction Z of the carrier arm 3*b*.

The reflector 2*a* is disposed on a reflector holder 8 which has a carrier receptacle 9 into which the carrier arm 3*b* of the board holder 3 can be inserted. The carrier receptacle 9 defines lateral guide grooves 9*a*, 9*b* here in which the lateral edges of the carrier arm 3*b* engage. Moreover, the carrier receptacle 9 is open to its upper side.

There are formed on the front end section of the LED board 1 on the one hand and on the front end region of the carrier receptacle 9 on the other hand contact surfaces that are assigned to one another in order to position the LED board 1 in the reflector holder 8 and so with respect to the reflector 2*a* when the carrier arm 3*b* is fully inserted into the carrier receptacle 9.

Specifically, the LED board 1 has on its front end region a centering projection 10 which engages in a corresponding centering recess 11 of the associated carrier receptacle 9 in order to center the LED board 1 in a Y direction running transversely to the direction of insertion Z. For this purpose, the centering projection 10 has on its opposing sides corresponding lateral contact surfaces 10*a*, 10*b* which come into contact with corresponding contact surfaces 11*a*, 11*b* of the centering recess 11. Furthermore, the LED board 1 and the reflector holder 8 have contact surfaces in order to position the LED board 1 on the reflector holder 8 in the direction of insertion Z. These Z contact surfaces 12*a*, 12*b*; 13*a*, 13*b* of the LED board 1 are formed here on the sides of the shoulder of the centering projection 10 of the board body 3*a* that lie opposite one another in the Y direction and on the shoulder surfaces of the carrier receptacle 9 provided on the centering recess 11.

In order to position the LED board 1 in an X direction which runs perpendicularly to the YZ plane, the lower side of the LED board 1 respectively forms a contact surface. A corresponding contact surface 14 is formed on the bottom of the carrier receptacle 9 and is elevated with respect to the surrounding bottom regions, i.e. the contact surface 14 projects upwards over the bottom of the carrier receptacle 9. The front end section of the contact surface 14 is in the form of a ramp incline 14*a* here that interacts with the associated LED board 1 in order to raise the latter when the carrier arm 3*b* is inserted.

In order to fit the LED light 1, the LED board 1 is first of all inserted into the two receptacles 4 of the carrier arms 3*b* of the board holder 3 from its open face side. Next the board holder 3 is connected to the reflector holder 8 by the carrier arms 3*b* of the board holder 3 being inserted into the associated carrier receptacle 9 of the reflector holder 8 until the board holder body 3*a* comes into contact with the reflector holder 8. In this final position the board holder 3 and the reflector holder 8 are connected, specifically screwed, detachably to one another.

When the carrier arm 3*b* is inserted into the carrier receptacle 9 the centering projection 10 on the front end region of the substrate 1*a* of the LED board 1 engages with the associated centering recess 11 of the carrier receptacle 9, by means of which the LED board 1 is centered in the Y direction. Moreover, the Z contact surfaces 12*a*, 12*b* in the region of the shoulders of the LED board 1 on the opposite sides of the centering projection 10 engage with the corresponding contact surfaces 13*a*, 13*b* of the reflector holder 8 in order to position the LED board 1 in the direction of insertion Z. After the positioning of the LED board 1 in the Z direction further insertion of the carrier arms 3*a* leads to the compression springs 6 being compressed in the rear end region of the receptacles 4 and so being tensioned so that it is ensured by the reset force of the compression springs 6 that the LED boards 1 are held against the Z contact surfaces 13*a*, 13*b* of the reflector holder 8.

Upon inserting the carrier arm 3*a* the LED board 1 is furthermore slightly raised by the interaction with the ramp incline 14*b* on the bottom of the carrier receptacle 9 against the reset force of the leaf spring 7 which overlaps the receptacle 4 so that the LED board 1 is pressed by the leaf spring 7 against the contact surface 14 on the bottom of the carrier receptacle 9 in order to position the LED board 1 in the X direction.

Figure 10:
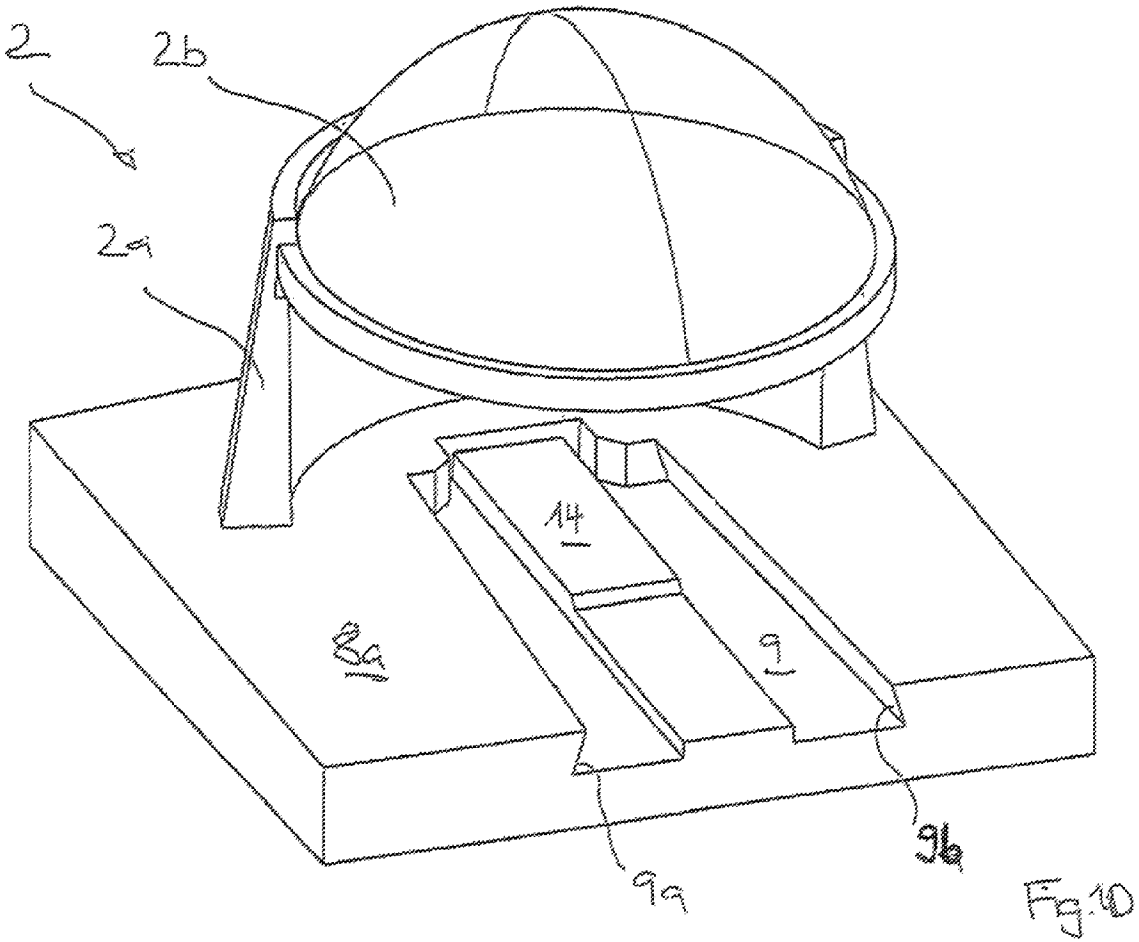

Finally, FIG. 10 shows a reflector holder 8 that carries an optical device 2 that comprises a reflector 2*a* and a lens 2*b* positioned on the latter. The carrier receptacle 9 is formed here as in the two embodiments described above. The lateral edges of the carrier receptacle 9 are formed like dove tails here in order to guide the correspondingly formed edges of an LED board and to fix them on the reflector holder so that they do not become detached towards the top.

It will be apparent to one of ordinary skill in the art that various modifications and variations can be made in construction or configuration of the present invention without departing from the scope or spirit of the invention. Thus, it is intended that the present invention cover all modifications and variations of the invention, provided they come within the scope of the following claims and their equivalents.

We claim:

1. A LED light, comprising a light unit having a LED board with a luminous surface and an optical device, the optical device comprising at least one reflector and/or at least one lens;

a reflector holder carrying the optical device and formed in one piece with the optical device;

a board holder detachably fastened to the reflector holder, the board holder comprising a receptacle in which the LED board is positioned, the LED board has a contact surface that comes into contact with a corresponding contact surface on the reflector holder positioning the LED board in the receptacle in registration with the optical device, the board holder has a board holder body and a carrier arm assigned to the light unit and projects in a straight line from a front side of the board holder body, the receptacle being formed on a free front end section of the carrier arm;

elastic pressurizing means provided on the board holder and/or the reflector holder, the elastic pressuring means elastically compresses and pushes the contact surface of the LED board against the contact surface of the reflector holder; and a carrier receptacle in the reflector holder and assigned to the carrier arm, the carrier arm is inserted into the carrier receptacle in a straight line from a rear side of the reflector holder, the carrier receptacle comprises lateral guide grooves in which the lateral edges of the carrier arm engage.

2. The LED light according to claim 1, wherein the receptacle is open to a front face side of the board holder and the LED board positioned in the receptacle on the open face side projects out of the receptacle, on an end section of the LED board projecting out of the receptacle the contact surface of the LED board is designed for the positioning of the LED board with respect to the optical device.

3. The LED light according to claim 1, wherein the LED board can be moved in the receptacle of the carrier arm parallel to a direction of insertion Z of the carrier arm and the elastic pressurizing means (6) is provided in a rear end region of the receptacle to elastically push the LED board out of the receptacle, the LED board has on its front end region a centering projection which engages a corresponding centering recess on the carrier receptacle to center the LED board in a Y direction transverse to the direction of insertion Z, the centering projection and the centering recess have lateral contact surfaces positioned opposite to one another.

4. The LED light according to claim 3, wherein the contact surface of the LED board and the contact surface of the reflector holder position the LED board on the reflector holder in the direction of insertion Z, the contact surface of the LED board is formed on opposite sides of the centering projection.

5. The LED light according to claim 1, wherein the contact surface is formed on a lower side of the LED board and interacts with the contact surface of the reflector holder which is elevated from a bottom of the assigned carrier receptacle to position the LED board in an X direction transverse to a direction of insertion Z.

6. The LED light according to claim 5, wherein the elastic pressurizing means act on an upper side of the LED board to press the lower side of the LED board against the contact surface of the reflector holder, a leaf spring is provided as the elastic pressurizing means on the board holder and extends from a rear side to a front side of the receptacle.

7. The LED according to claim 1, wherein a board holder body comes to rest against the reflector holder to fix an end position of the board holder with respect to the reflector holder in a direction of insertion Z.

8. The LED light according to claim 1, wherein the board holder is screwed to the reflector holder and/or control electronics for the LED boards are provided on the board holder and/or a total of four light units are provided.

9. The LED light according to claim 3, the contact surface is formed on a lower side of the LED board and interacts with the contact surface of the reflector holder which is elevated from a bottom of the carrier receptacle to position the LED board in an X direction transverse to the direction of insertion Z.

10. The LED light according to claim 4, the contact surface is formed on a lower side of the LED board and interacts with the contact surface of the reflector holder which is elevated from a bottoms of the carrier receptacle to position the LED board in an X direction transverse to the direction of insertion.

11. The LED light a cording to claim 3, wherein the board holder body comes to rest against the reflector holder to fix an end position of the board holder with respect to the reflector holder in a direction of insertion Z.

12. The LED light according to claim 4, wherein the board holder body comes to rest against the reflector holder to fix an end position of the board holder with respect to the reflector holder in a direction of insertion Z.

13. The LED light according to claim 5, wherein the board holder body comes to rest against the reflector holder to fix an end position of the board holder with respect to the reflector holder in a direction of insertion Z.

14. The LED light according to claim 6, wherein the board holder body comes to rest against the reflector holder to fix an end position of the board holder with respect to the reflector holder in a direction of insertion Z.

15. A reflector arrangement for a LED light, comprising:

a light unit having a LED board with a luminous surface and an optical device;

a reflector holder carrying the optical device and formed in one piece with the optical device;

a carrier receptacle in the reflector holder configured for insertion of a carrier arm of a board holder in a straight line from a rear side of the reflector holder, the carrier receptacle comprising lateral guide grooves configured to engage lateral edges of the carrier arm, the carrier arm configured to project in a straight line from a front side of the board holder; and a contact surface formed in a front end region of the carrier receptacle and configured to position a LED board in the carrier receptacle.

16. The reflector arrangement according to claim 15, wherein a centering recess and the contact surface are formed in the carrier receptacle in the region of a face side end surface of the carrier receptacle to center the LED board in a Y direction transverse to a direction of insertion Z and/or the contact surface is formed in the region of the bottom of the carrier receptacle.

* * * * *